US008356715B2

(12) United States Patent
Brasseur

(10) Patent No.: US 8,356,715 B2
(45) Date of Patent: Jan. 22, 2013

(54) APPARATUS AND METHOD FOR SORTING MATERIAL

(75) Inventor: Alain Brasseur, Ste-Catherine-de-Hatley (CA)

(73) Assignee: 6358357 Canada Inc., Sherbrooke, Quebec (CA)

( * ) Notice: Subject to any disclaimer, the term of this patent is extended or adjusted under 35 U.S.C. 154(b) by 473 days.

(21) Appl. No.: 12/295,702

(22) PCT Filed: Apr. 4, 2007

(86) PCT No.: PCT/CA2007/000591

§ 371 (c)(1),
(2), (4) Date: May 7, 2010

(87) PCT Pub. No.: WO2007/112593

PCT Pub. Date: Oct. 11, 2007

(65) Prior Publication Data

US 2010/0219111 A1 Sep. 2, 2010

Related U.S. Application Data

(60) Provisional application No. 60/788,739, filed on Apr. 4, 2006.

(51) Int. Cl.
*B07C 5/12* (2006.01)

(52) U.S. Cl. ..... 209/672; 209/12.2; 209/667; 209/668; 209/673; 414/412

(58) Field of Classification Search ..... 209/667, 209/668, 672, 673; 414/412
See application file for complete search history.

(56) References Cited

U.S. PATENT DOCUMENTS

| | | | | | |
|---|---|---|---|---|---|
| 4,452,694 | A | | 6/1984 | Christensen et al. | |
| 5,051,172 | A | * | 9/1991 | Gilmore | 209/672 |
| 5,450,966 | A | * | 9/1995 | Clark et al. | 209/672 |
| 5,484,247 | A | * | 1/1996 | Clark et al. | 414/412 |
| 5,485,925 | A | | 1/1996 | Miller et al. | |
| 5,799,801 | A | | 9/1998 | Clark et al. | |
| 5,960,964 | A | * | 10/1999 | Austin et al. | 209/672 |
| 6,149,018 | A | * | 11/2000 | Austin et al. | 209/672 |

(Continued)

FOREIGN PATENT DOCUMENTS

WO WO 94/20227 9/1994

*Primary Examiner* — Terrell Matthews
(74) *Attorney, Agent, or Firm* — Merchant & Gould P.C.

(57) ABSTRACT

An apparatus for sorting material, includes a frame, at least one first shaft rotatably mounted onto the frame, and at least one second shaft rotatably mounted onto the frame in a substantially adjacent and parallel relationship with respect to the at least one first shaft. The first and second shafts define a conveying surface along which material to be sorted is intended to travel via a rotation of the shafts. At least one single disc is mounted in a substantially transverse relationship with respect to the at least one first shaft. At least one compound disc is mounted in a substantially transverse relationship with respect to the at least one second shaft, each compound disc having a main disc and an associated secondary disc, each main disc having an outside perimeter greater than that of the associated secondary disc, each secondary disc being in alignment with the at least one single disc of an adjacent first shaft. Such a simplified disc arrangement provides a zigzagging pattern of spacings, while enabling an easier interchangeably of components which is advantageous in reducing assembling, operating, maintenance and/or repair costs, as well as in improving sorting capability.

28 Claims, 11 Drawing Sheets

U.S. PATENT DOCUMENTS 6,237,778 B1 5/2001 Weston
6,250,478 B1 6/2001 Davis
6,318,560 B2 * 11/2001 Davis ..... 209/672
6,371,305 B1 * 4/2002 Austin et al. ..... 209/672
6,726,028 B2 * 4/2004 Visscher et al. ..... 209/668
2010/0282647 A1 * 11/2010 Miller et al. ..... 209/12.2

* cited by examiner

APPARATUS AND METHOD FOR SORTING MATERIAL

This application is a National Stage Application of PCT/CA2007/000591, filed Apr. 4, 2007, which claims benefit of U.S. Ser. No. 60/788,739 filed Apr. 4, 2006 and which application is incorporated herein by reference. To the extent appropriate, a claim of priority is made to each of the above disclosed applications.

FIELD OF THE INVENTION

The present invention relates to an apparatus and method for sorting material.

BACKGROUND OF THE INVENTION

Apparatuses and methods for sorting or screening recycled material and the like are very well known in the art.

U.S. Pat. No. 5,960,964 granted on Oct. 5, 1999 to AUSTIN et al. relates to a method and apparatus for sorting recycled material. A compound disc is used to eliminate a secondary slot normally formed between adjacent shafts of a material separation screen. The compound disc comprises a primary disc joined to an associated secondary disc. The primary disc and the secondary disc each have the same shape but the secondary disc has a smaller outside perimeter and is wider. The primary disc and associated secondary disc are formed from a unitary piece of rubber. The compound discs are interleaved with oppositely aligned compound discs on adjacent shafts. In other words, the large disc is positioned on a shaft to align with a smaller disc on an adjacent shaft. The oppositely aligned and alternating arrangement between the large discs and small discs reduces problems that exist in screens that use in-line multi-sided discs.

Also known to the Applicant are the following US patents and/or patent applications which describe other apparatuses and machines for sorting material: 5,450,966; 5,484,247; 5,485,925; 5,799,801; 6,149,018; 6,371,305 B1; and 6,726,028 B2.

Also known to the Applicant are the following foreign patents and/or patent applications which also describe other apparatuses and machines for sorting or screening material: Belgium 0849006; Germany 69721199.1; Spain 0849006; Finland 0849006; France 0849006; United Kingdom 0849006; Netherlands 0849006; Sweden 0849006; Canada 2,199,021; Canada 2,224,918.

However, a substantial drawback associated with several of the above-mentioned apparatuses is that they rely on the provision of compound discs provided on each adjacent shafts and in an alternating manner for carrying out a given sorting capability. However, it is also known in the art that in regards to material separation screens, it is preferable to have a configuration or design that enables namely to reduce assembling, operating, maintenance and/or repair costs associated with the operation of the separation screens. Furthermore, it is also known in the art that a substantial drawback associated with the exclusive use of compound discs is the fact that they are fairly costly to manufacture. Moreover, the provision of compound discs being interleaved with oppositely aligned compound discs on adjacent shafts results in aligned spacings throughout the entirety of the conveying surface of the screener which is also disadvantageous for certain screening or sorting applications.

Hence, in light of the aforementioned, there is a need for an improved sorting apparatus, which by virtue of its design and components, would be able to overcome some of the above-discussed prior art problems.

SUMMARY OF THE INVENTION

The object of the present invention is to provide an apparatus which, by virtue of its design and components, satisfies some of the above-mentioned needs and is thus an improvement over other related sorting devices and/or methods known in the prior art.

In accordance with the present invention, the above object is achieved, as will be easily understood, with an apparatus such as the one briefly described herein and such as the one exemplified in the accompanying drawings.

More particularly, according to the present invention, there is provided an apparatus for sorting material, the apparatus comprising:

a frame;

at least one first shaft rotatably mounted on the frame;

at least one second shaft rotatably mounted on the frame in a substantially adjacent and parallel relationship with respect to said at least one first shaft, said first and second shafts defining a conveying surface along which material to be sorted is intended to travel via a rotation of the shafts;

at least one single disc mounted in a substantially traverse relationship with respect to the at least one first shaft; and at least one compound disc mounted in a substantially traverse relationship with respect to the at least one second shaft, each compound disc having a main disc and an associated secondary disc, each main disc having an outside perimeter greater than that of the associated secondary disc, each secondary disc being in alignment with the at least one single disc of an adjacent first shaft.

Preferably, the discs of the apparatus are arranged so that a spacing defined between neighboring discs on a first shaft is offset with respect to a spacing defined between corresponding neighboring discs on an adjacent second shaft.

Preferably also, the discs of the apparatus are arranged so that a first spacing defined between a first pair of neighboring discs on a first shaft is substantially different than a second spacing defined between a second pair of neighboring discs on an adjacent second shaft.

According to yet another aspect of the present invention, there is also provided a material separation screen or assembly provided with the above-mentioned apparatus.

According to yet another aspect of the present invention, there is also provided a method of securing the above-mentioned apparatus onto the above-mentioned material separation screen or assembly.

According to yet another aspect of the present invention, there is also provided a method for operating the above-mentioned apparatus, material separation screen and/or assembly.

According to yet another aspect of the present invention, there is also provided a kit for assembling the above-mentioned apparatus, material separation screen and/or assembly.

According to yet another aspect of the present invention, there is also provided a method for assembling components of the above-mentioned kit.

According to yet another aspect of the present invention, there is also provided a method of manufacturing the above-mentioned apparatus, material separation screen and/or assembly.

According to yet another aspect of the present invention, there is also provided at least one material having been sorted with the above-mentioned apparatus, method, material separation screen, and/or assembly.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

In the following description, the same numerical references refer to similar elements. The embodiments, dimensions, components and/or geometrical configurations shown in the figures are preferred, for exemplification purposes only.

In the context of the present description, the expression "apparatus" includes all types of screening, sorting and/or separating devices, and the like. Moreover, although the present invention was primarily designed for screening or sorting recycled material, and the like, it may be used with other kinds of items, or for other usages requiring sorting of different materials, as apparent to a person skilled in the art. For this reason, the expression "recycled", "material", "paper", etc. should not be taken as to limit the scope of the present invention and includes all other kinds of usages or items with which the present invention may be used and could be useful.

Moreover, in the context of the present description, the expressions "apparatus", "screen", "screener", "disc arrangement", "device", "assembly" and "unit", as well as any other equivalent expressions and/or compound words thereof, may be used interchangeably. The same applies for any other mutually equivalent expressions, such as "screening", "sorting", "separating" and "recycling", for example, as well as "single", "unique", "individual" and "non-compound" when referring namely to disc 11, as also apparent to a person skilled in the art.

In addition, although the preferred embodiments of the present invention as illustrated in the accompanying drawings comprise various components, etc., and although the preferred embodiments of the sorting apparatus 1 and corresponding parts of the present invention as shown consist of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the sorting apparatus 1 according to the present invention, as will be briefly explained herein and as can be easily inferred herefrom by a person skilled in the art, without departing from the scope of the invention.

Figure 1:
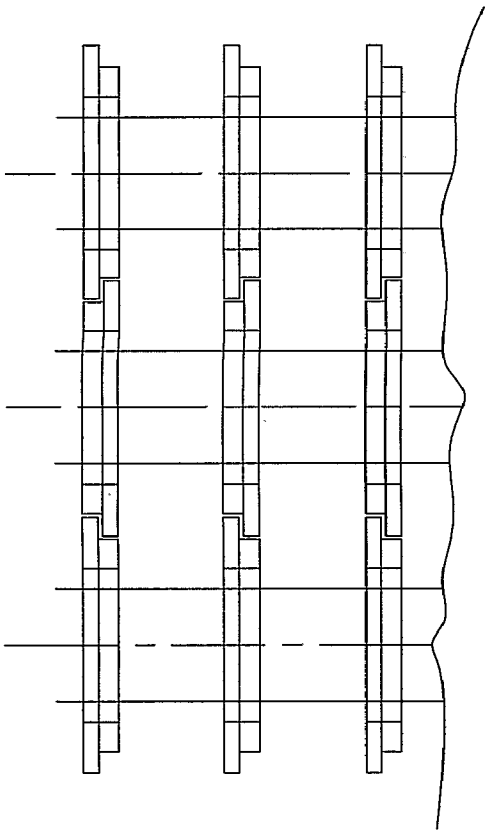
FIG. 1 (PRIOR ART)
FIG. 1 is a schematic representation of a sorting apparatus using a disc arrangement according to the prior art.
Figure 4:
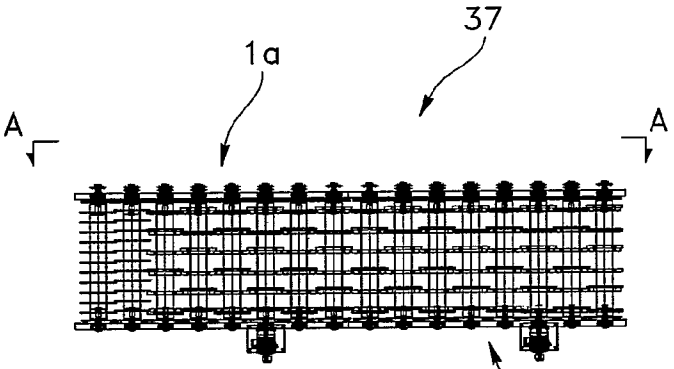
FIG. 4 is a top plan view of what is shown in FIG. 3.
Figure 6:
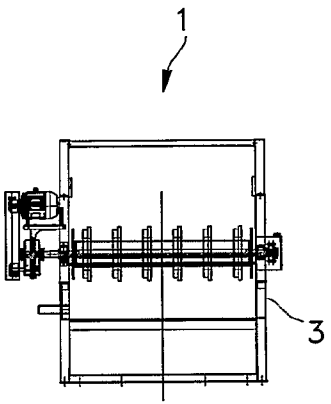
FIG. 6 is a rear side view of what is shown in FIG. 3.

Broadly described, the sorting apparatus 1 according to the present invention, as exemplified in the accompanying drawings, is an apparatus 1, with corresponding method, for separating various materials, similar to what is described in U.S. Pat. Nos. 5,450,966; 5,484,247; 5,485,925; 5,799,801; 5,960,964; 6,149,018; 6,371,305 B1; and 6,726,028 B2, the contents of which are incorporated herein by reference, the improvement wherein instead of having a disc arrangement comprising compound discs mounted in oppositely aligned and alternating arrangement as shown in FIG. 1, the disc arrangement according to the preferred embodiment of the present invention comprises a unique and single disc 11 mounted about a corresponding shaft and between non-alternating compound discs 13 mounted on diametrically opposite shafts, as better exemplified in FIG. 2. According to the present invention, this unique and single disc 11 is preferably mounted between the secondary discs 17 of the above-mentioned two compound discs 13, as also better shown in FIG. 2.

This unique and single intermediate disc 11, along with the main and the secondary discs 15,17 of the compound discs 13, may comprise arched sides 27, and the like, as will be explained in greater detail hereinbelow.

A substantial advantage from the above-discussed disc arrangement according to the present invention is that it substantially reduces assembling, operating, maintenance and/or repair costs associated with the operation of a separation screen assembly according to the present invention, while not necessarily affecting the overall screening capability thereof, and in some cases, actually improving it, as briefly explained hereinbelow.

Indeed, according to the present invention, there is provided an apparatus 1 for sorting material. As can be easily understood when referring to the accompanying drawings, the apparatus 1 comprises a frame 3, at least one first shaft 5 rotatably mounted on the frame 3, and at least one second shaft 7 rotatably mounted on the frame 3 in a substantially adjacent and parallel relationship with respect to said at least one first shaft 5, said first and second shafts 5,7 defining a conveying surface 9 along which material to be sorted is intended to travel via a rotation of the shafts 5,7, in a manner well known in the art.

Figure 2:
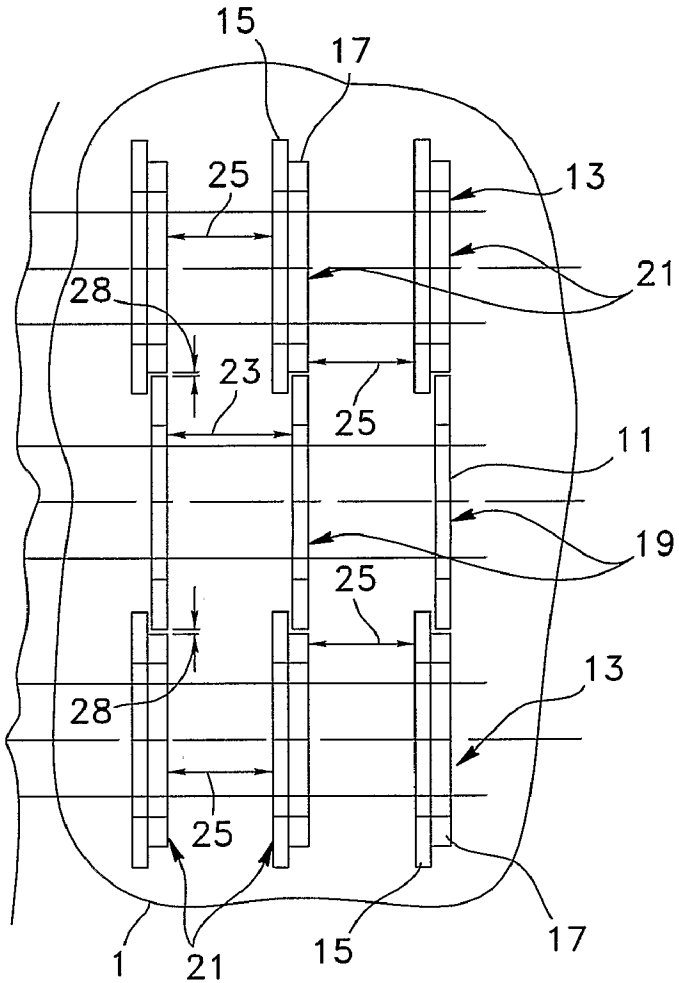
FIG. 2 is a schematic representation of a sorting apparatus using a disc arrangement according to a preferred embodiment of the present invention.
Figures 15, 16, 17:
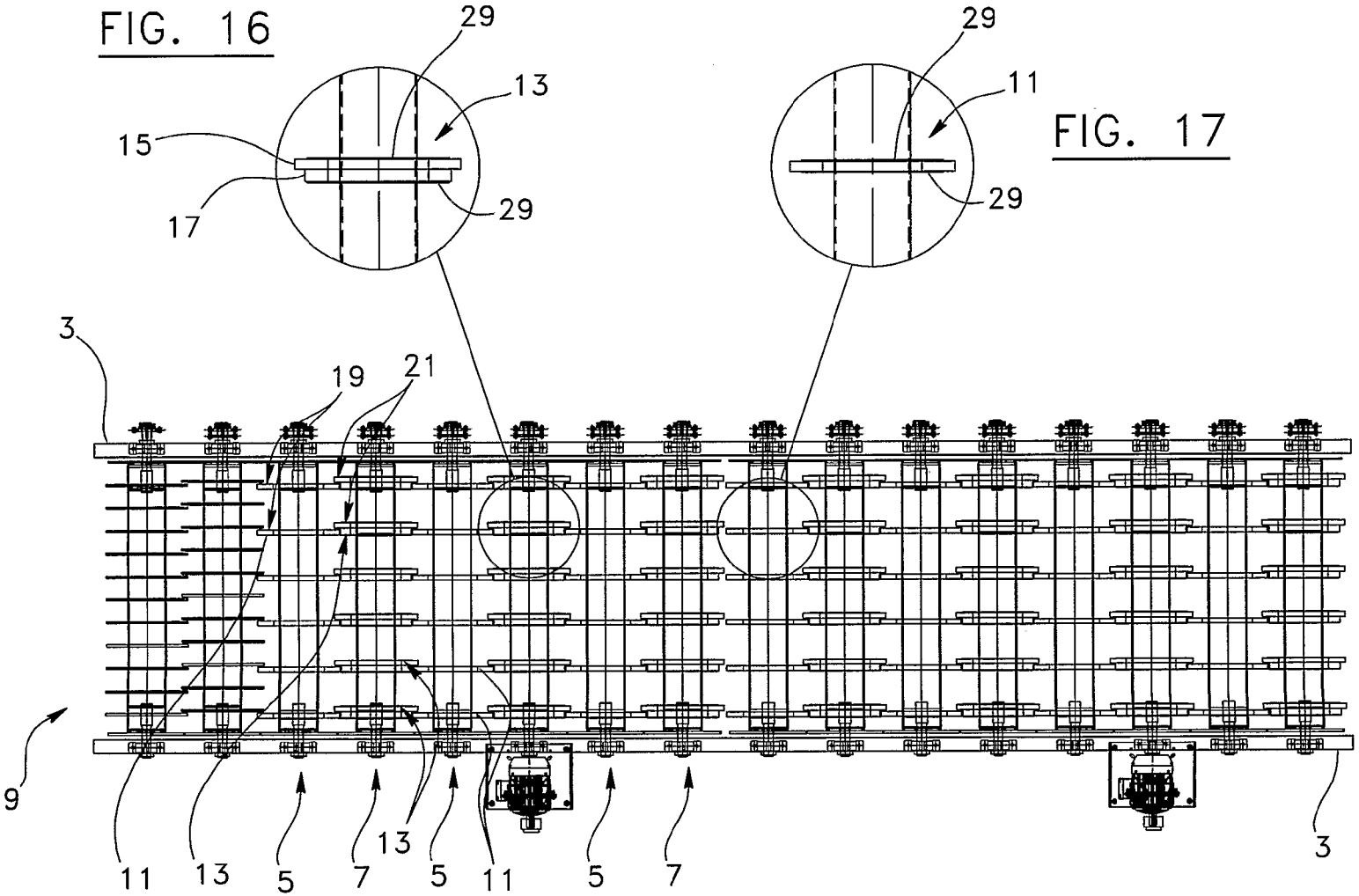
FIG. 15 is a top plan view of a sorting apparatus according to yet another preferred embodiment of the present invention.
FIG. 16 is an enlarged view of a compound disc shown in FIG. 15.
FIG. 17 is an enlarged view of a single disc shown in FIG. 15.
Figures 18, 19, 20:
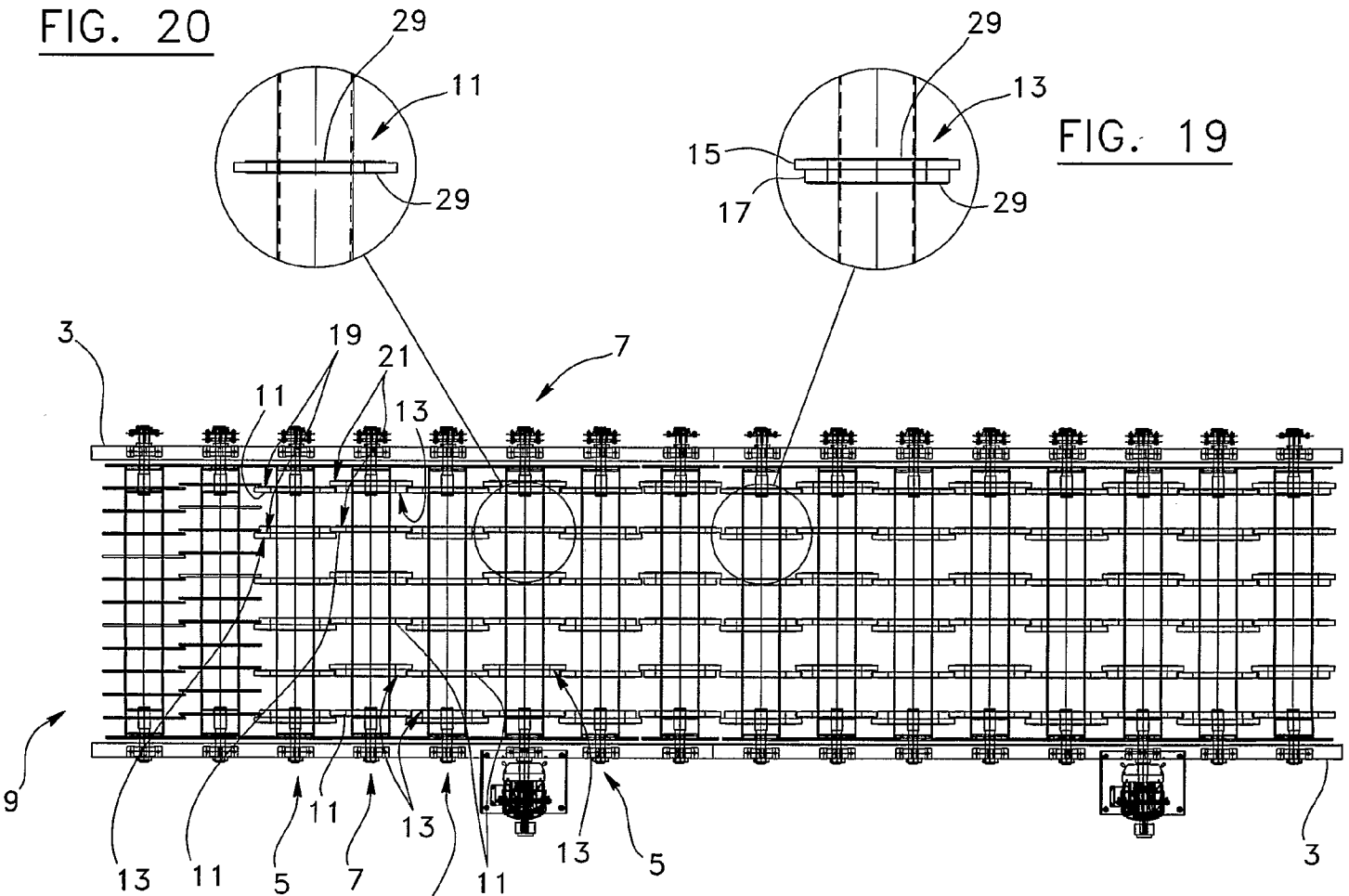
FIG. 18 is a top plan view of a sorting apparatus according to yet another preferred embodiment of the present invention.
FIG. 19 is an enlarged view of a compound disc shown in FIG. 18.
FIG. 20 is an enlarged view of a single disc shown in FIG. 18.
Figure 21:
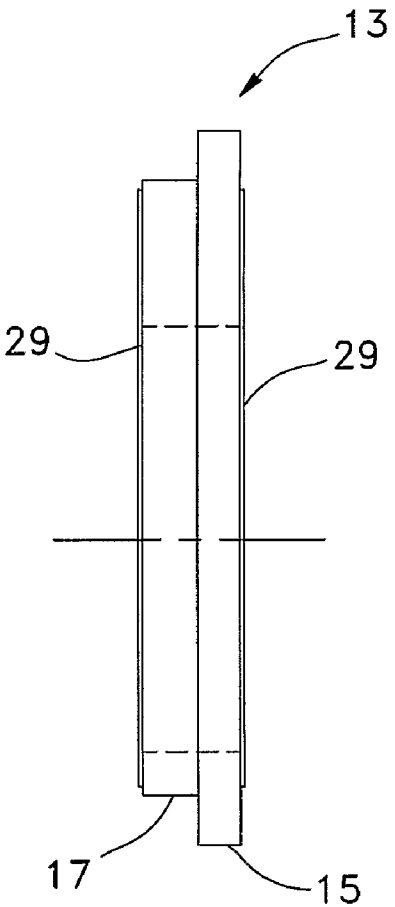
FIG. 21 is a top plan view of a compound disc according to a preferred embodiment of the present invention, the compound disc being shown provided with corresponding support plates.
Figure 22:
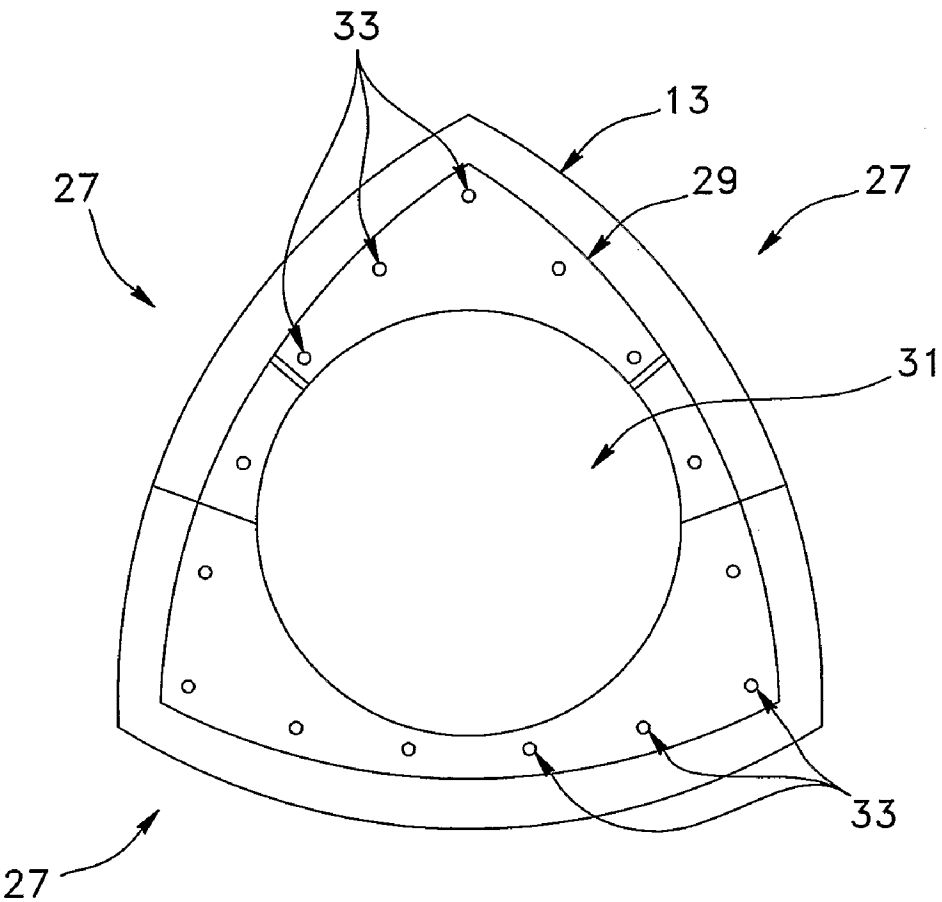
FIG. 22 is a side view of what is shown in FIG. 21.
Figure 23:
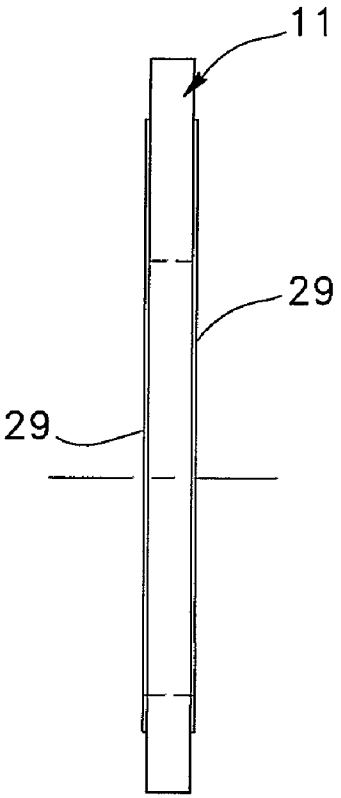
FIG. 23 is a top plan view of a single disc according to a preferred embodiment of the present invention, the single disc being shown provided with corresponding support plates.

An important aspect of the present invention resides in that the apparatus 1 also comprises at least one single disc 11 mounted in a substantially traverse relationship with respect to the at least one first shaft 5, and at least one compound disc 13 mounted in a substantially traverse relationship with respect to the at least one second shaft, each compound disc 13 having a main disc 15 and an associated secondary disc 17, each main disc 15 having an outside perimeter greater than that of the associated secondary disc 17, as better shown in FIG. 21, each secondary disc being in alignment with the at least one single disc of an adjacent first shaft, as better exemplified in FIGS. 2, 15 and 18.

Preferably, the discs 11,13 of the apparatus 1 are arranged so that a spacing 23 defined between neighboring discs 19 on a first shaft 5 is offset with respect to a spacing 25 defined between corresponding neighboring discs 21 on an adjacent second shaft 7, as also better shown in FIGS. 2, 15 and 18. An important advantage of this particular configuration is that contrary to the prior art, the present invention provides spacings 23,25 which present themselves in a substantially "zigzag" pattern along the conveying surface 9 of the apparatus 1, as can be easily understood when referring to the "discontinuous" lane illustrated in FIG. 2, which improves sorting capabilities given the fact that a given material to be sorted that would not fall through spacing 25, could fall within spacing 23 as a result of the fact that it is not aligned with spacing 25, for example.

Preferably also, the discs 11,13 of the apparatus 1 are arranged so that a first spacing 23 defined between a first pair of neighboring discs 19 on a first shaft is substantially different than a second spacing 25 defined between a second pair of neighboring discs 21 on an adjacent second shaft, as also better shown in FIG. 2.

In one particular embodiment of the present invention, as better exemplified in FIG. 15, the first pair of neighboring discs 19 is a pair of single discs 11, and the second pair of neighboring discs 21 is a pair of compound discs 13. Preferably also, and as shown, each first shaft 5 is exclusively provided with a plurality of single discs 11, and each second shaft 7 is exclusively provided with a plurality of compound discs 13. Preferably also, in such an embodiment, the main discs 15 of the compound discs 13 of each second shaft 7 face towards a same side of the frame 3, that is, in the case of the embodiment illustrated in FIG. 15, the main discs 15 of the compound discs 13 face in an upward direction with respect to the drawing. It is worth mentioning however that the discs 11,13 may be disposed differently while maintaining an offset between the spacing 23 of neighboring discs 19 on a first shaft 5 with respect to a spacing 25 between neighboring discs 21 on a second shaft 7 in which case, for example, the main discs 15 of the compound discs 13 of a given second shaft 7 could face towards a given side of the frame 3, and the main discs 15 of the compound discs 13 of another second shaft 7 could face towards another side of the frame 3.

According to another preferred embodiment of the present invention, and as better exemplified in FIG. 18, each first pair of neighboring discs 19 may comprise a compound disc 13 and a single disc 11, in which case, each shaft 5,7 is preferably provided with a plurality of alternating single discs 11 and compounds discs 13.

Preferably also, and as shown in FIG. 18, the main discs 15 of the compound discs 13 of the first shafts 5 face towards a given side of the frame 3, and the main discs 15 of the compound discs 13 of the second shafts 7 face towards another side of the frame 3.

Preferably also, the apparatus 1 according to the present invention comprises a suitable driving mechanism for rotatably driving the shafts 5,7 and corresponding discs 11,13, and such a suitable driving mechanism may be provided with corresponding appropriate components, such as motors, chains, sprockets, reducers, and the like, as apparent to a person skilled in the art. Thus, in the context of the present description and since such driving mechanisms are well known in the art, there is no further need to provide further details in this regard, or regarding the possible variants that could be used therewith.

As better shown in FIGS. 22-25, each disc, whether a single disc 11, a compound disc 13 (including main disc 15 and associated secondary disc 17), etc., comprises arched sides 27, and even more preferably, each such disc comprises three arched sides 27.

Preferably also, each secondary disc 17 is wider than its associated main disc 15, as better exemplified in FIG. 21.

Preferably also, the single discs 11 and the main discs 15 of the compounds discs 13 have an outer perimeter being substantially the same. However, it is worth mentioning, as can be easily understood by a person skilled in the art when referring to FIG. 2, that, unlike prior art disc arrangements which often rely on the presence of compound discs being disposed in a complementary and alternating combination such as is the case in U.S. Pat. No. 5,960,964, as better exemplified in FIG. 1 for example, the provision of a single and unique disc 11 between compound discs 13 according to the present invention enables to have intermediate discs, namely the single and unique disc 11, that could be of a different outer perimeter than that of the corresponding main discs 15 of the compound discs 13, which enables to modify, and if need may be, depending on which particular applications the apparatus 1 is intended for, the gap 41 between the single disc 11 and the secondary disc 17 of the corresponding and adjacent compound disc 13 mounted onto an adjacent shaft for example, as exemplified in FIG. 2.

According to another innovative aspect of the present invention, each disc, whether a single disc 11 or a compound disc 13, is preferably contained between a pair of support plates 29 securely mountable onto a given shaft 5,7 of the frame 3, as better shown in FIGS. 18-30.

Preferably also, each support plate 29 is complementary in shape with respect to that of its associated disc 11,13,15,17, and further has an outer perimeter smaller than that of said associated disc 11,13,15,17, as better exemplified in FIGS. 21-24.

Preferably also, each support plate 29 of the apparatus 1 has substantially the same outer perimeter, so as to namely, advantageously enable an easier interchangeability of components within the apparatus 1 and corresponding assembly 37.

As also better shown in FIGS. 21-26, each support plate 29 preferably has a central orifice 31 through which a corresponding shaft of the apparatus 1 is extendable, and each support plate 29 is preferably secured in a suitable manner onto the corresponding shaft 5,7, either in a removable manner for example, or securely, via welding for example, although other suitable means could be used, as apparent to a person skilled in the art.

As also better shown in FIGS. 21-29, each support plate 29 preferably comprises a plurality of through-holes 33 disposed adjacent a peripheral surface area of said support plate 29 for removably securing a corresponding disc 11,13,15,17 between a pair of such support plates 28 by inserting fasteners into said corresponding disc 11,13,15,17 via the through-holes 33 of the support plates 29. The discs 11,13,15,17 are also preferably provided with corresponding through-holes 33.

Figure 25:
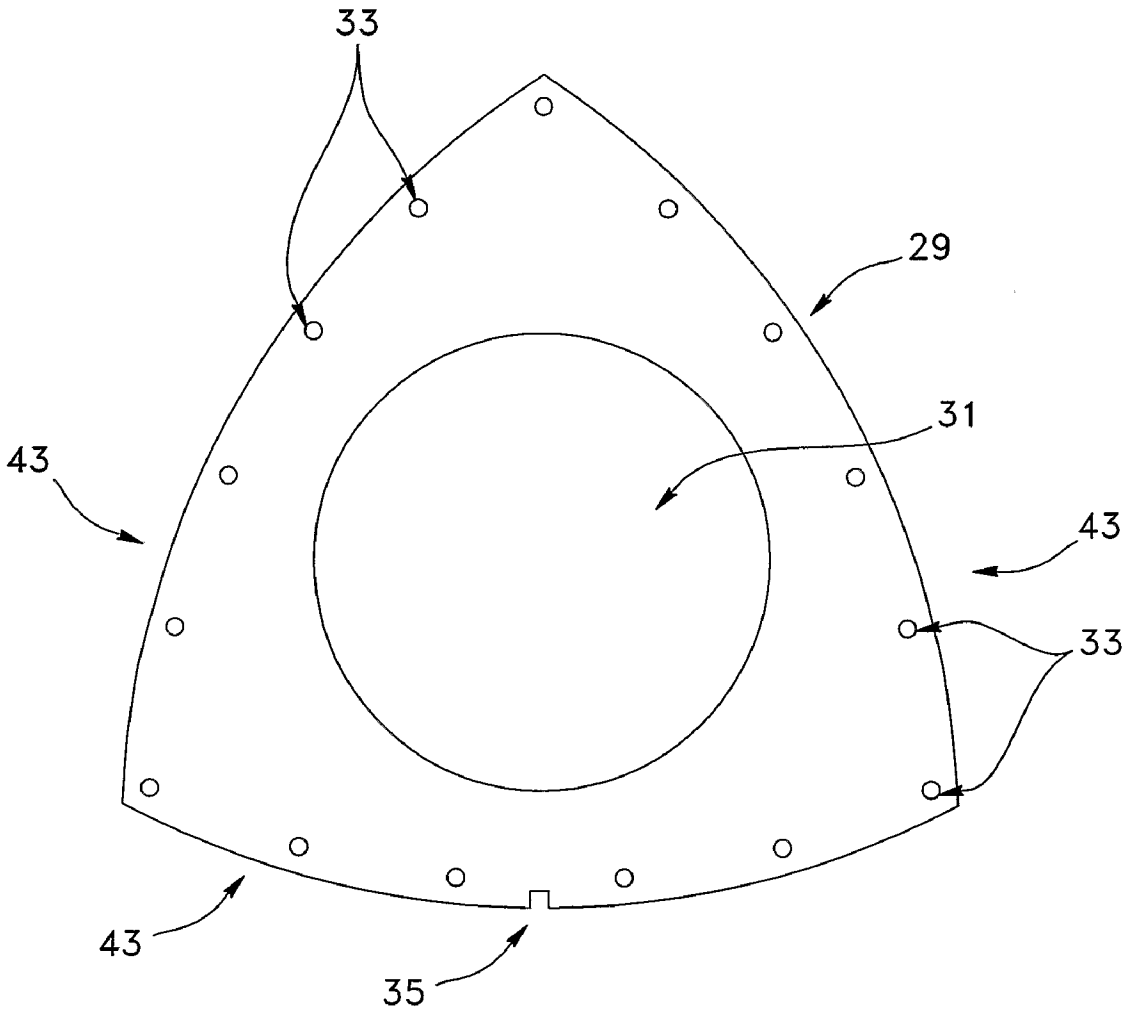
FIG. 25 is a side view of a support plate according to a preferred embodiment of the present invention.
Figure 29:
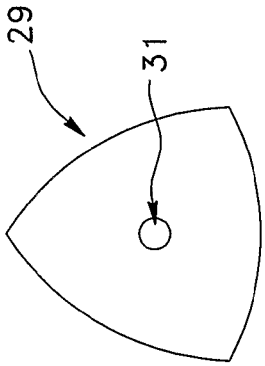
FIG. 29 is a side view of one of the end plate shown in FIG. 26.
Figure 28:
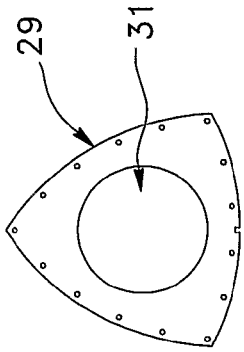
FIG. 28 is a side view of one of the support plates shown in FIG. 26.
Figure 26:
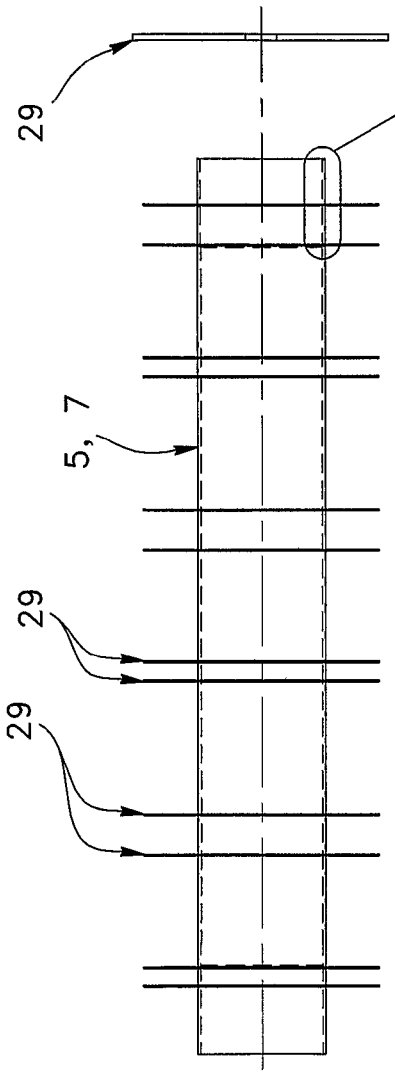
FIG. 26 is a side elevational view of a shaft provided with corresponding plates according to a preferred embodiment of the present invention.
Figure 27:
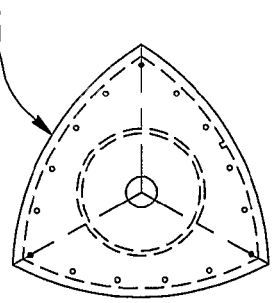
FIG. 27 is a side view of what is shown in FIG. 26.
Figure 30:
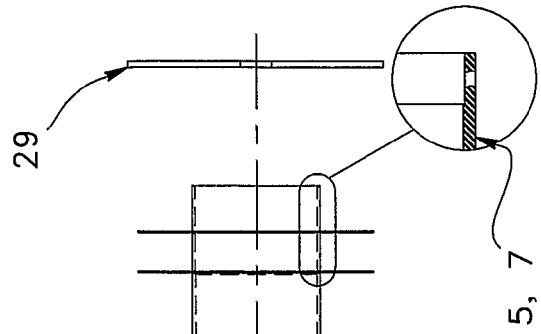
FIG. 30 is an enlarged portion of a section of the shaft shown in FIG. 26.

Preferably also, and as better shown in FIG. 25, each support plate 29 comprises arched sides 43, and one of said arches sides 43 of the support plate is provided with a corresponding notch 35 so that notches 35 and corresponding support plates 29 of a given same shaft 5,7 may be aligned with respect to one another along said given same shaft 5,7, by ensuring namely that all the notches 35 are aligned with one another if the corresponding support plates 29 are all advantageously and preferably of the same size for example, as aforementioned.

Figure 24:
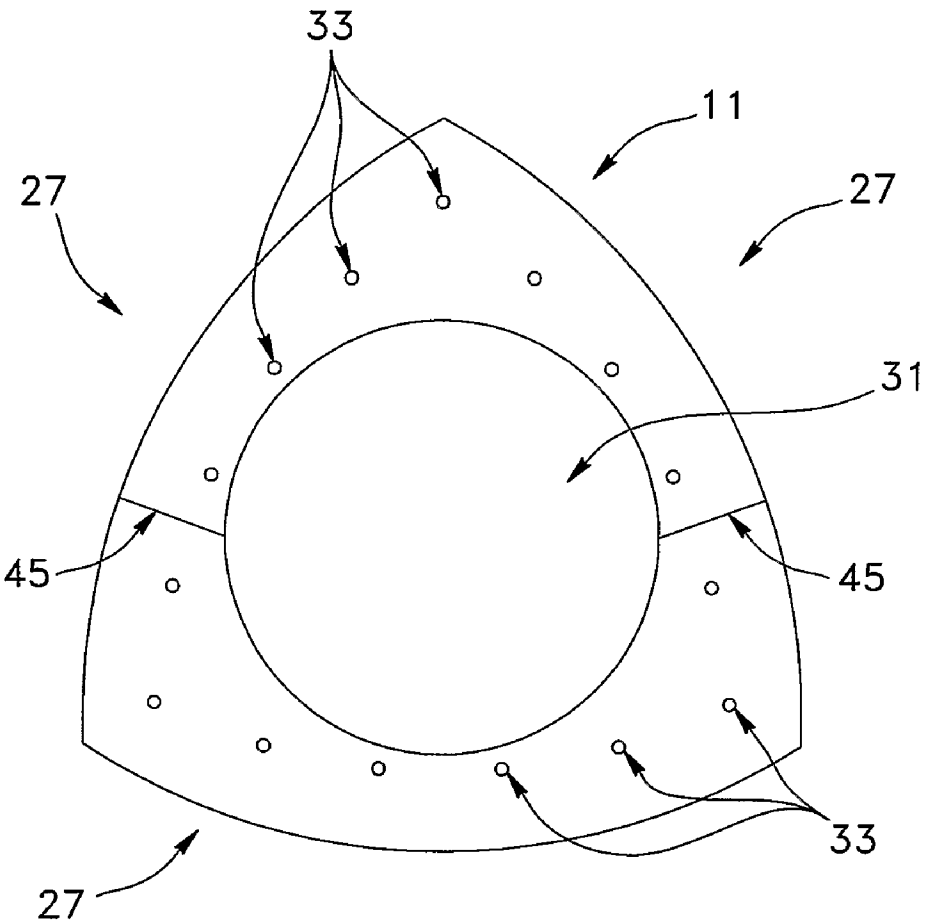
FIG. 24 is a side view of the single disc shown in FIG. 23, the single disc being now shown deprived of its corresponding support plates.

As can be easily understood when referring to FIG. 24 for example, each disc according to the present invention, whether a single disc 11, a compound disc 13, including main disc 15 and associated secondary disc 17, is preferably made of at least two sub-discs joinable to each other along splitting surfaces 45 so as to form said each disc. This is particularly advantageous in that it enables to easily and advantageously replace broken, damaged and/or worn-out discs 11,13,15,17 of the present apparatus 1 by easily replacing the corresponding sub-discs associated to the affected discs giving that these sub-discs are removably contained and affixed between support plates 29, via fasteners inserted into corresponding through-holes 33, as explained hereinabove.

Preferably also, the discs 11,13,15,17 are made of a rubberized material, and the support plates 29 are made of a metallic material, but it is worth mentioning, as apparent to a person skilled in the art, that other various different suitable materials may be used for the discs 11,13,15,17 and support plates 29 according to the present invention, depending on the particular applications for which the apparatus 1 is intended for.

According to the preferred embodiment of the present invention, as exemplified in FIGS. 3, 7, 9 and 13, the frame 3 and corresponding shafts 5,7 are disposed in an inclined relationship with respect to a ground surface.

According to another aspect of the present invention, there is also provided an assembly 37 for sorting material, the assembly 37 comprising first and second apparatuses 1 such as the one briefly described herein and such as the one exemplified in the accompanying drawings. The first apparatus 1*a* has a front end and a rear end, the first apparatus 1*a* inclining upward at a given angle with respect to a ground surface from its front end to its rear end, and the second apparatus 1*b* has also a front end and a rear end, the second apparatus 1*b* also inclining upward at a given angle with respect to a ground surface from its front end to its rear end, the front end of the second apparatus 1*b* being located underneath the rear end of the first apparatus 1*a*, as better shown in FIGS. 3 and 9.

Preferably also, the assembly 37 further comprises a roll over section 39 joined to the rear end of the first apparatus 1*a* and extending downwardly from said rear end of the first apparatus 1*a*, the roll over section 39 being suspended above the second apparatus 1*b* thereby dropping material while moving in a downwardly angled and forward direction onto the second apparatus 1*b*.

According to another aspect of the present invention, there is also provided a method of sorting material, the method comprising the steps of: a) providing an apparatus 1 such as the one briefly described herein and such as the one exemplified in the accompanying drawings; b) rotating the shafts 5,7 and corresponding discs 11,13 in the same direction; and c) dropping material to be sorted onto the conveying surface 9 so that shaft rotation causes the material to be pushed by the discs 11,13 along the conveying surface 9 while at the same time screening the material via corresponding spacings 23,25 defined between the discs 11,13.

Figure 3:
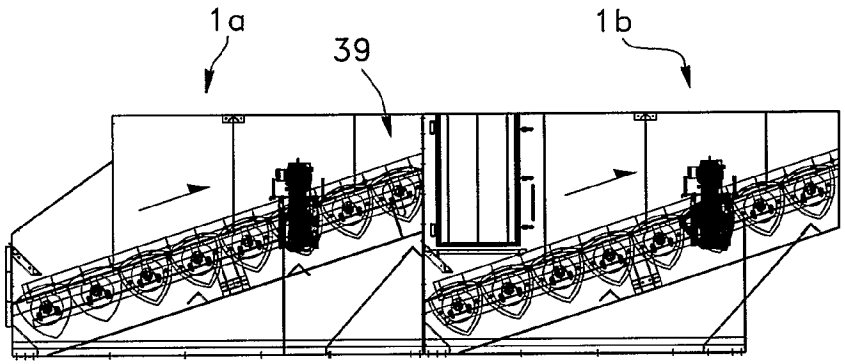
FIG. 3 is a side elevational view of a multi-stage screen assembly for separating material according to a preferred embodiment of the present invention.
Figure 7:
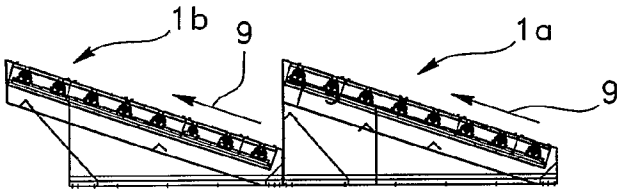
FIG. 7 is a view taken along plane A-A of FIG. 4.
Figure 5:
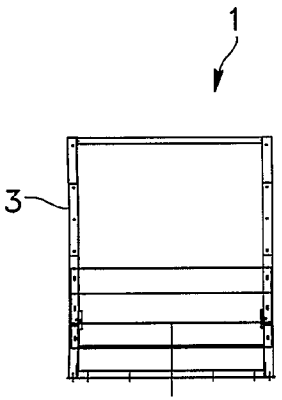
FIG. 5 is a front side view of what is shown in FIG. 3.
Figure 8:
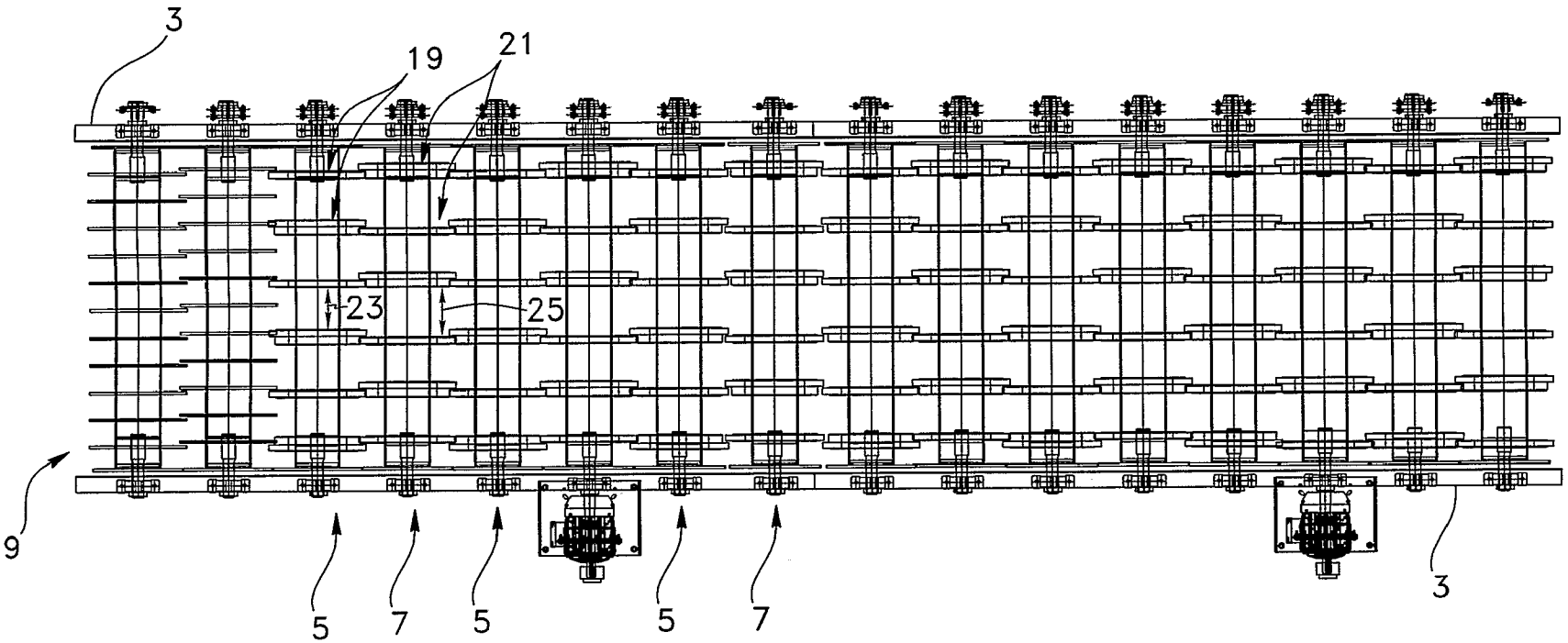
FIG. 8 is an enlarged view of what is shown in FIG. 4.
Figure 10:
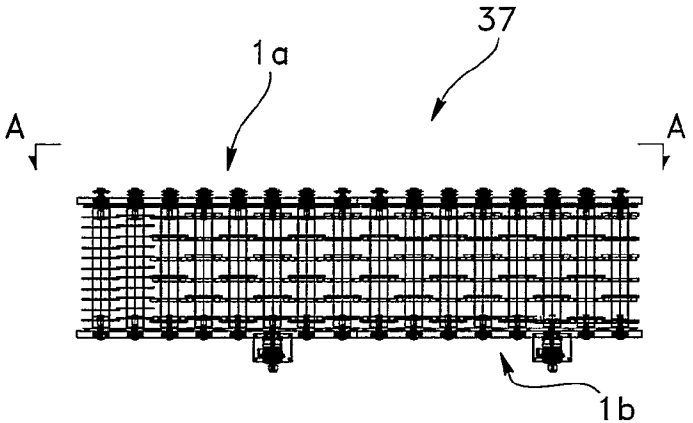
FIG. 10 is a top plan view of what is shown in FIG. 9.
Figure 12:
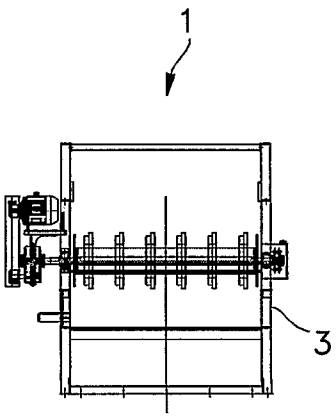
FIG. 12 is a rear side view of what is shown in FIG. 9.
Figure 9:
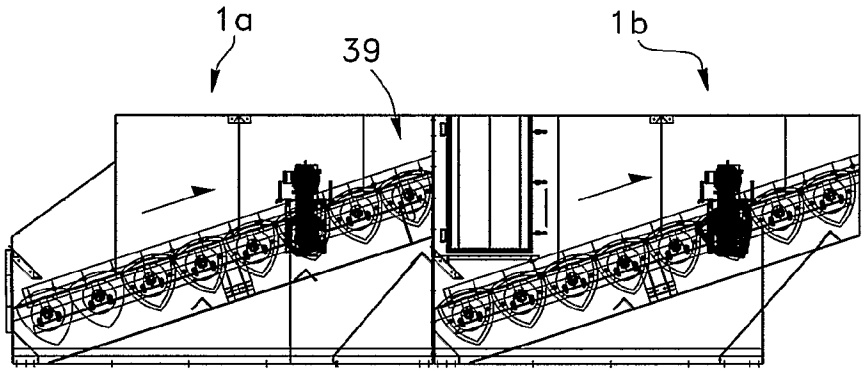
FIG. 9 is a side elevational view of a multi-stage screen assembly for separating material according to another preferred embodiment of the present invention.
Figure 13:
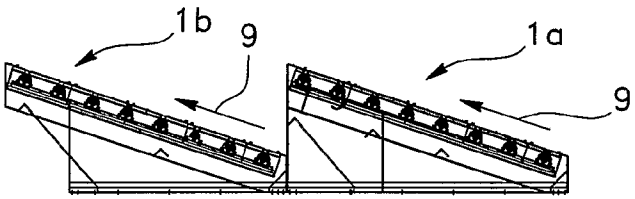
FIG. 13 is a view taken along plane A-A of FIG. 10.
Figure 11:
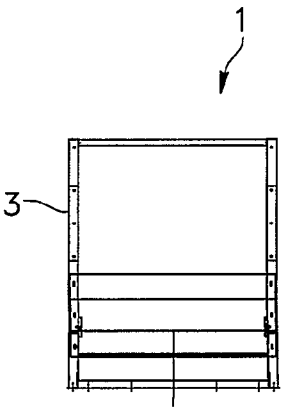
FIG. 11 is a front side view of what is shown in FIG. 9.
Figure 14:
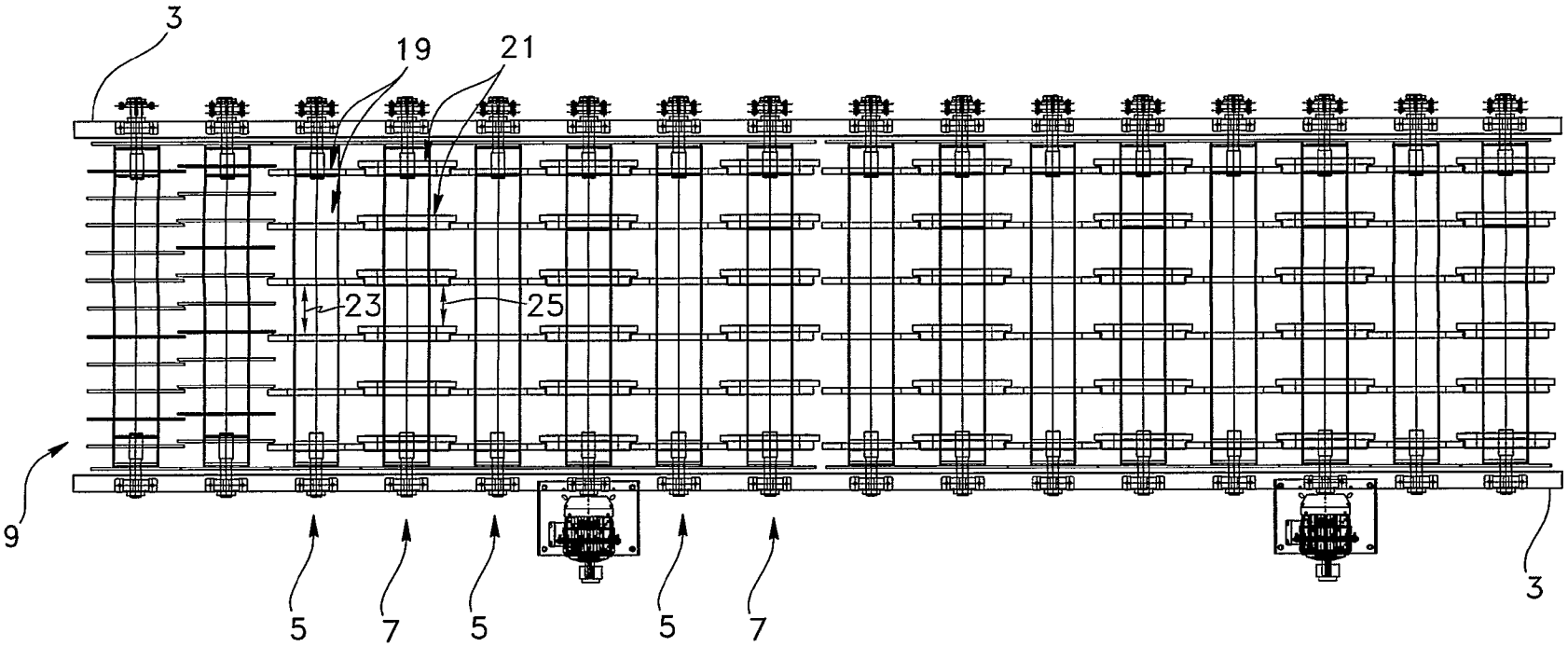
FIG. 14 is an enlarged view of what is shown in FIG. 10.

Preferably also, the method further comprising the steps of: d) providing first and second apparatuses 1*a*,1*b*, each one of said apparatuses 1 having a front end and a rear end; and e) placing each one of the apparatuses 1 in an upwardly inclining relationship with respect to a ground surface, so that the front end of second apparatus 1*b* is located underneath the rear end of the first apparatus 1*a*, as better shown in FIGS. 3 and 9.

Preferably also, the method further comprising the steps of: f) providing a roll over section 39 joined to the rear end of the first apparatus 1*a* and extending downward from said rear end of the first apparatus 1*a*, the roll over section 39 being suspended above the second apparatus 1*b* thereby dropping material while moving in a downward direction in an downwardly angled and forward direction onto the second apparatus 1*b*.

According to other aspects of the present invention, there is also provided a material separation screen provided with the above-mentioned apparatus 1 or disc arrangement; a method of securing the above-mentioned apparatus 1 on the above-mentioned material separation screen; a method for operating the above-mentioned material separation screen; a kit for assembling the above-mentioned material separation screen; a method for assembling components of the above-mentioned kit; a method of manufacturing the above-mentioned material separation screen; and at least one material having been sorted with the above-mentioned apparatus 1, method and/or material separation screen, as exemplified and as can be easily understood by a person skilled in the art when referring to FIGS. 2-30 of the present application.

Moreover, according to the present invention, the sorting apparatus 1 and corresponding parts are preferably made of substantially rigid materials, such as polymeric materials (plastic, rubber, etc.), hardened polymers, composite materials, metallic materials, and/or the like, in order to achieve the resulting advantages briefly discussed herein, depending on the particular applications for which the apparatus 1 is intended for and the different parameters in cause (gripping capabilities desired; sorting capabilities; nature of materials being sorted; resistant to wear and tear, and impact resistant, etc.), as apparent to a person skilled in the art.

As being now better appreciated, the present invention is an improvement and presents several advantages over other related devices and/or methods known in the prior art. Indeed, the present invention is particularly advantageous in that by preferably providing a single and unique intermediate disc 11 on a given shaft 5,7, between compound discs 13 mounted on diametrically opposite shafts, as exemplified in FIG. 2, one can substantially reduce assembling, operating, maintenance and/or repair costs associated with the operation of the separation screen assembly according to the present invention, while obtaining many other advantages in terms of improved sorting capability and the like, thanks to spacings 23 between neighboring discs 19 on a first given shaft 5, which are offset with respect to corresponding spacings 25 of corresponding neighboring discs 21 provided on an adjacent second shaft 7, and that these spacings 23,25 are preferably of different dimensions, thereby providing added advantages, as briefly explained hereinabove and as can be easily understood by a person skilled in the art in view of the above description and the accompanying drawings.

Of course, numerous modifications could be made to the above-described embodiments without departing from the scope of the invention, as defined in the appended claims.

The invention claimed is:

1. An apparatus for sorting material, the apparatus comprising:

a frame;

at least one first shaft rotatably mounted on the frame;

at least one second shaft rotatably mounted on the frame in a substantially adjacent and parallel relationship with respect to said at least one first shaft, said first and second shafts defining a conveying surface along which material to be sorted is intended to travel via a rotation of the shafts;

at least one single disc mounted in a substantially traverse relationship with respect to the at least one first shaft; and at least one compound disc mounted in a substantially traverse relationship with respect to the at least one second shaft, each compound disc having a main disc and an associated secondary disc, each main disc having an outside perimeter greater than that of the associated secondary disc, each secondary disc being in alignment with the at least one single disc of an adjacent first shaft, wherein the discs of the apparatus are arranged so that a spacing defined between neighboring discs on a first shaft is offset with respect to a spacing defined between corresponding neighboring discs on an adjacent second shaft.

2. An apparatus according to claim 1, wherein the discs of the apparatus are arranged so that a first spacing defined between a first pair of neighboring discs on a first shaft is substantially different than a second spacing defined between a second pair of neighboring discs on an adjacent second shaft.

3. An apparatus according to claim 2, wherein the first pair of neighboring discs is a pair of single discs, and wherein the second pair of neighboring discs is a pair of compound discs.

4. An apparatus according to claim 1, wherein each first shaft is exclusively provided with a plurality of single discs, and wherein each second shaft is exclusively provided with a plurality of compound discs.

5. An apparatus according to claim 1, wherein the main discs of the compound discs of each second shaft face towards a same side of the frame.

6. An apparatus according to claim 1, wherein the main discs of the compound discs of a given second shaft face towards a given side of the frame, and wherein the main discs of the compound discs of another second shaft face towards another side of the frame.

7. An apparatus according to claim 2, wherein each first pair of neighboring discs comprises a compound disc and a single disc.

8. An apparatus according to claim 7, wherein each shaft is provided with a plurality of alternating single discs and compounds discs.

9. An apparatus according to claim 7, wherein the main discs of the compound discs of the first shafts face towards a given side of the frame, and wherein the main discs of the compound discs of the second shafts face towards another side of the frame.

10. An apparatus according to claim 1, wherein the apparatus comprises a driving mechanism for rotatably driving the shafts and corresponding discs.

11. An apparatus according to claim 1, wherein each disc comprises arched sides.

12. An apparatus according to claim 1, wherein each disc comprises three arched sides.

13. An apparatus according to claim 1, wherein each secondary disc is wider than its associated main disc.

14. An apparatus according to claim 1, wherein the single discs and the main discs of the compounds discs have an outer perimeter being substantially the same.

15. An apparatus according to claim 1, wherein each disc is contained between a pair of support plates securely mountable onto a given shaft of the frame.

16. An apparatus according to claim 15, wherein each support plate is complementary in shape with respect to that of its associated disc, and further has an outer perimeter smaller than that of said associated disc.

17. An apparatus according to claim 15, wherein each support plate of the apparatus has substantially the same outer perimeter.

18. An apparatus according to claim 15, wherein each support plate has a central orifice through which a corresponding shaft of the apparatus is extendable.

19. An apparatus according to claim 15, wherein each support plate comprises a plurality of through-holes disposed adjacent a peripheral surface area of said support plate for removably securing a corresponding disc between a pair of such support plates by inserting fasteners into said corresponding disc via the through-holes of the support plates.

20. An apparatus according to claim 15, wherein each support plate comprises arched sides, and wherein one of said arches sides of the support plate is provided with a corresponding notch so that notches and corresponding support plates of a given same shaft may be aligned with respect to one another along said given same shaft.

21. An apparatus according to claim 15, wherein each disc is made of at least two sub-discs joinable to each other along splitting surfaces so as to form said each disc.

22. An apparatus according to claim 15, wherein the discs are made of a rubberized material, and wherein the support plates are made of a metallic material.

23. An apparatus according to claim 15, wherein the frame and corresponding shafts are disposed in an inclined relationship with respect to a ground surface.

24. An assembly for sorting material, the assembly comprising first and second apparatuses such as the one defined in claim 1, wherein the first apparatus has a front end and a rear end, the first apparatus inclining upward at a given angle with respect to a ground surface from its front end to its rear end, and wherein the second apparatus has a front end and a rear end, the second apparatus also inclining upward at a given angle with respect to a ground surface from its front end to its rear end, the front end of the second apparatus being located underneath the rear end of the first apparatus.

25. An assembly according to claim 24, wherein the assembly further comprises a roll over section joined to the rear end of the first apparatus and extending downwardly from said rear end of the first apparatus, the roll over section being suspended above the second apparatus thereby dropping material while moving in a downwardly angled and forward direction onto the second apparatus.

26. A method of sorting material, the method comprising the steps of:

a) providing an apparatus such as the one defined in claim 1;

b) rotating the shafts and corresponding discs in the same direction; and c) dropping material to be sorted onto the conveying surface so that shaft rotation causes the material to be pushed by the discs along the conveying surface while at the same time screening the material via corresponding spacings defined between discs.

27. A method according to claim 26, wherein the method further comprising the steps of:

d) providing first and second apparatuses, each one of said apparatuses having a front end and a rear end; and e) placing each one of the apparatuses in an upwardly inclining relationship with respect to a ground surface, so that the front end of the second apparatus is located underneath the rear end of the first apparatus.

28. A method according to claim 27, wherein the method further comprising the steps of:

f) providing a roll over section joined to the rear end of the first apparatus and extending downward from said rear end of the first apparatus, the roll over section being suspended above the second apparatus thereby dropping material while moving in a downward direction in an downwardly angled and forward direction onto the second apparatus.

* * * * *